US011608662B2

(12) United States Patent
Drost et al.

(10) Patent No.: US 11,608,662 B2
(45) Date of Patent: Mar. 21, 2023

(54) MOTOR VEHICLE DOOR LOCK

(71) Applicant: Kiekert AG, Heiligenhaus (DE)

(72) Inventors: Bernhard Drost, Isselburg (DE); Christian Sturm, Krefeld (DE)

(73) Assignee: Kiekert AG, Heiligenhaus (DE)

( * ) Notice: Subject to any disclaimer, the term of this patent is extended or adjusted under 35 U.S.C. 154(b) by 130 days.

(21) Appl. No.: 17/251,927

(22) PCT Filed: Jun. 5, 2019

(86) PCT No.: PCT/DE2019/100501
§ 371 (c)(1),
(2) Date: Dec. 14, 2020

(87) PCT Pub. No.: WO2019/238164
PCT Pub. Date: Dec. 19, 2019

(65) Prior Publication Data

US 2021/0317688 A1 Oct. 14, 2021

(30) Foreign Application Priority Data

Jun. 13, 2018 (DE) ..... 10 2018 114 063.0

(51) Int. Cl.

| | |
|---|---|
| ***E05B 81/56*** | (2014.01) |
| ***E05B 77/54*** | (2014.01) |
| ***E05B 79/20*** | (2014.01) |
| ***E05B 81/06*** | (2014.01) |
| ***E05B 81/50*** | (2014.01) |

(Continued)

(52) U.S. Cl.
CPC ..... *E05B 81/56* (2013.01); *E05B 77/54* (2013.01); *E05B 79/20* (2013.01); *E05B 81/06* (2013.01);

(Continued)

(58) Field of Classification Search
CPC ..... E05B 81/56; E05B 81/58; E05B 81/06; E05B 81/50; E05B 81/66; E05B 81/76;

(Continued)

(56) References Cited

U.S. PATENT DOCUMENTS 6,518,720 B1 * 2/2003 Frantz ..... E05B 81/58 70/264
9,163,435 B2 * 10/2015 Zysk ..... E05B 83/26

(Continued)

FOREIGN PATENT DOCUMENTS

CN 204715943 U * 10/2015
DE 10143263 C1 5/2003

(Continued)

OTHER PUBLICATIONS

Translation of International Search Report dated Sep. 2, 2019, for International Patent Application No. PCT/DE2019/100501.

*Primary Examiner* — Christine M Mills
*Assistant Examiner* — James E Ignaczewski
(74) *Attorney, Agent, or Firm* — Renner, Otto, Boisselle & Sklar, LLP

(57) ABSTRACT

A motor vehicle door lock which is equipped with a body-side motor vehicle door lock and a bonnet-side or door-side locking bolt bracket, or vice-versa. Furthermore, at least one opening/retracting drive for a locking mechanism and a handle for manual emergency opening of the locking mechanism are provided in the motor vehicle door lock. According to the invention a locking element, the position of which is checked with the aid of at least one sensor, is associated with the handle.

17 Claims, 9 Drawing Sheets

(51) Int. Cl.
*E05B 81/66* (2014.01)
*E05B 83/26* (2014.01)

(52) U.S. Cl.
CPC ..... *E05B 81/50* (2013.01); *E05B 81/66* (2013.01); *E05B 83/26* (2013.01); *E05Y 2900/536* (2013.01); *E05Y 2900/548* (2013.01)

(58) Field of Classification Search
CPC ..... E05B 77/54; E05B 79/20; E05B 85/12; E05B 83/26; E05B 83/00; E05Y 2900/536; E05Y 2900/548
See application file for complete search history.

(56) References Cited

U.S. PATENT DOCUMENTS

| | | | | |
|---|---|---|---|---|
| 2003/0058088 | A1* | 3/2003 | Franke | E05B 77/54 307/10.1 |
| 2006/0255595 | A1* | 11/2006 | Schretzlmeier | E05B 83/26 292/93 |
| 2013/0238187 | A1* | 9/2013 | Zysk | E05B 81/56 701/36 |

FOREIGN PATENT DOCUMENTS

| | | | | |
|---|---|---|---|---|
| DE | 102005021740 | A1 | 11/2006 | |
| DE | 202008003845 | U1 | 8/2009 | |
| DE | 202008003845 | U1 * | 9/2009 | E05B 77/12 |
| DE | 102012004792 | A1 | 9/2013 | |
| DE | 102016117282 | A1 * | 3/2018 | E05B 77/16 |
| DE | 102016117282 | A1 | 3/2018 | |
| DE | 102018001021 | A1 * | 8/2019 | |
| EP | 0217169 | A1 | 4/1987 | |

* cited by examiner

MOTOR VEHICLE DOOR LOCK

FIELD OF DISCLOSURE

The invention relates to a motor vehicle door lock, including a body-side motor vehicle door lock and associated lock housing and a bonnet-side or door-side locking bolt bracket, or vice versa, further including at least one opening/retracting drive for a locking mechanism in the motor vehicle door lock or lock housing, and including a handle for manual emergency opening of the locking mechanism. —The motor vehicle door lock in question is not restrictively a motor vehicle front bonnet lock or motor vehicle tailgate lock; respectively, the aforementioned motor vehicle door lock is a component of the motor vehicle door lock in question in addition to the additionally provided locking bolt bracket.

BACKGROUND OF DISCLOSURE

Such motor vehicle door locks first of all have the two basic components, namely the motor vehicle door lock or the lock housing with the locking mechanism situated therein consisting essentially of a catch and a pawl on the one hand and the associated locking bolt bracket or locking bolt on the other hand. The lock housing is usually provided on the body side, and may for example be attached in the area of a front bonnet or tailgate opening in or on the body. In the first-mentioned case, the motor vehicle door lock is designed as a motor vehicle front bonnet lock. The last-mentioned variant corresponds to a motor vehicle tailgate lock.

In contrast, the locking bolt bracket is situated on the bonnet side or door side. However, the reverse approach may also be used. In this case, the locking bolt bracket is connected to the body, whereas the lock housing and with it the associated motor vehicle door lock is attached to the bonnet or door. As a rule, however, the lock housing is to be found on the body side and the locking bolt bracket is to be found on the bonnet or door side, as is described in vary basic terms in DE 10 2016 117 282 A1 of the applicant.

Such motor vehicle front bonnets or tailgate locks are nowadays generally opened or closed by a motor. The opening/retracting drive for the locking mechanism is provided for this purpose in the lock housing. The opening drive ensures that in the case of a motor vehicle front bonnet lock, for example, a pawl as part of the locking mechanism made up of a catch and pawl, and optionally a drive pawl are opened. The drive pawl in this case is part of the retracting drive and, together with the retracting drive, ensures that, for example, a locking mechanism situated manually in the pre-ratchet position is moved into the main ratchet position and retracted.

In addition, with such motor vehicle door locks or motor vehicle front bonnet locks or also motor vehicle tailgate locks, a handle is provided, with the aid of which the locking mechanism may be opened manually in an emergency via a connecting element. An action of the handle consequently results in the connecting element being acted upon and in this way the locking mechanism experiencing an emergency opening.

In the generic prior art according to EP 0 217 169 A1, a retracting drive is provided, which pivots the catch as part of the locking mechanism from the pre-ratchet position into the main ratchet position. In addition, an emergency release lever is provided, with the aid of which an emergency opening as shown overall in FIG. 2 of EP 0 217 169 A1 may be carried out.

The state of the art has generally proven successful. However, an emergency opening is not generally possible in the case of motor vehicle front and tailgate locks. Due namely to legal requirements, for example, the bonnet or door may only partially open as the associated motor vehicle is being driven, for example, in order to supply fresh air to the front bonnet area or to the area of the tailgate. This is considered to be absolutely necessary, for example, in order to supply people accidentally trapped here with fresh air. For safety reasons, however, a complete opening must be avoided while driving. For this reason, the bonnet or door may only be partially opened until a so-called catch position has been reached. Furthermore, the catch position may usually only be reached while driving with the aid of the emergency opening via the handle. A motorized opening by means of the opening drive, on the other hand, is usually not permitted while driving and is of course specifically possible when the vehicle is stationary.

The catch position corresponds, for example, with motor vehicle bonnet locks, in addition to the locking mechanism made up of catch and pawl, also having a catch hook. When closing a bonnet, a door or a cover with the locking bolt bracket arranged on it, the catch hook in question is pivoted into its closed position, in which it engages behind the locking bolt or locking bolt bracket. The locking bolt or locking bolt bracket is thus secured twice, on the one hand by the catch held in the closed position with the aid of the pawl, and on the other hand by the aforementioned catch hook.

In order to open such a motor vehicle front bonnet lock or also tailgate lock or generally a catch hook lock, the locking mechanism is acted upon with the aid of the opening drive. For this purpose, a handle provided in the interior of a motor vehicle body may be provided, which acts on the opening drive and ensures that the locking mechanism is opened by an electric motor. This means the opening drive only ensures that with its help, the pawl is generally lifted from its engagement with the catch and may accordingly open the locking mechanism in the lock housing. In the process, the catch hook invariably ensures that the locking bolt or locking bolt bracket is held in place. This corresponds to the catch position previously described.

In order to be able to open such a hook lock completely, it is also necessary to pivot the hook which still securing the locking bolt bracket so that the locking bolt bracket and thus the bonnet or tailgate are released. The pivoting of the catch hook in this case is carried out regularly by a vehicle driver, who for this purpose must reach through a gap between the body and the bonnet, for example, at the front of the motor vehicle, in order to operate the catch hook. This gap is created by the fact that after the described opening process of the locking mechanism, the bonnet is set up with the aid of the opening drive at least until the catch position is reached. This is ensured by a spring or may be ensured by any restoring forces of a door seal or bonnet seal.

In practice, motor vehicle front bonnet locks may usually only be opened by an electric motor with the aid of the opening drive from inside the motor vehicle body (when the vehicle is stationary). This is then no longer possible if the on-board supply voltage is insufficient. This means a vehicle driver is still able to get into the motor vehicle in this case because, for example, a lock cylinder with a mechanical key or emergency key ensures that at least the motor vehicle door is opened. However, in the exemplary case described, the battery, which may often be reached via the front bonnet, is not accessible. In addition, plausible solutions for preventing a complete opening of the front bonnet or tailgate while driving are lacking if, in addition, for example, inside the motor vehicle, the handle mechanically coupled to the locking mechanism via the connecting element is acted uoon to open the locking mechanism manually in an emergency. Here, the invention seeks to provide an overall remedy.

SUMMARY OF DISCLOSURE

The invention is based on the technical problem of further developing such a motor vehicle lock in such a way that a functionally reliable mechanical emergency opening is provided, in particular, without the risk of unintended opening of the bonnet or door.

To solve this technical problem, a generic motor vehicle door lock within the scope of the invention is characterized in that the handle is assigned a locking element, the position of which is checked with the aid of at least one sensor.

The handle is usually mechanically coupled to the locking mechanism via a connecting element. In this way, the locking mechanism is able to be opened manually in an emergency. In the course of the manual emergency opening, the locking mechanism and possibly a drive pawl as part of a retracting drive are usually opened. A catch hook may also be opened. As a result, the locking bolt bracket is completely free and the bonnet may be opened.

In order to prevent an unintentional complete opening, for example while driving, the handle is assigned the locking element. The locking element may be moved into a position that locks and releases at least the handle. For this purpose, the locking element generally interacts with a stop on the connecting element to limit the path of the connecting element.

The handle generally has an extension which at least partially acts on the locking element. In fact, the design is such that when the handle for emergency opening of the locking mechanism of the motor vehicle door lock is acted upon, the extension operates on the locking element and acts on it at least to the extent that the sensor checking the position of the locking element is also acted upon. In this case, however, the locking element does not (yet) ensure that the handle is blocked. This takes place instead with the aid of a locking drive assigned to the locking element. As soon as the locking drive acts on the locking element, the locking element changes from its position in which the handle is released into the position in which the handle is locked.

In this locked position of the handle, the handle can only be acted upon while taking into account a first stroke, with the aid of which the pawl may be opened from its engagement with the catch and, if necessary, a drive pawl. However, the additional and usually provided catch hook ensures in this case that the locking bolt bracket is secured and held in place. Only when the locking element is moved into its handle-releasing position with the aid of the locking drive is the handle able to perform a second stroke following the first stroke and thereby also open the catch hook. The bonnet may now be completely swung open.

The locking element is designed more specifically as a predominantly linearly guided locking slider. The locking slider has a locking lug which moves into a position that locks the handle. In this locking position, the locking nose is situated in front of a stop on the connecting element between the handle and the locking mechanism, so that the action of the handle up to the first stroke is limited by the fact that the stop on the connecting element moves against the locking nose, and consequently the action of the handle up to the first stroke is limited in this manner. This opens only the pawl and, if necessary, a drive pawl. The catch hook continues to secure the catch. After completing this first stroke of the handle, the bonnet transitions into a catch position.

The locking element is generally furnished with a contour that acts on the sensor. This is particularly recommended due to the fact that the sensor is typically designed as a microswitch or a switch in general. The contour provided on the locking element or locking slider ensures that the sensor or switch or microswitch is acted upon with the aid of the contour as soon as the locking element or the locking slider is acted upon with the aid of the handle or of the extension on the handle. In addition, the sensor or switch is also acted upon, as before and unchanged, as soon as the locking drive moves the locking element into the position that locks the handle.

Signals from the sensor are usually processed by a control unit. The control unit then acts on the opening/retracting drive for the locking mechanism and/or on the locking drive for the locking element as a function of signals from the sensor. If, for example, the handle is acted upon and a signal is generated at the sensor, the control unit is able to interpret this in terms of the opening/retracting drive for the locking mechanism being acted upon to open the locking mechanism, for example, when the motor vehicle is at a standstill. For this purpose, the control unit generally also evaluates signals of a speed sensor and/or of at least one door contact switch.

If the control unit determines a significant speed on the basis of signals from the speed sensor, the control unit then generally acts on the locking drive for the locking element in such a way that the locking element is moved from its previously assumed position in which the handle is released into the position in which the handle is locked. This ensures that any actions on the handle while driving result at best in the locking mechanism and possibly the drive pawl being opened. The associated front bonnet transitions into its catch position. The catch hook continues to secure the catch so that the front bonnet is unable to move into its fully opened position. At the same time, the bonnet or front bonnet may be motorically moved into the catch hook position with the aid of the opening/retracting drive in order, for example, to supply a person inadvertently located there with fresh air. If the opening/retracting drive for the locking mechanism should fail, the bonnet or tailgate in question may also be moved into the aforementioned catch position with the aid of the handle for opening the bonnet manually in an emergency.

The signal from the sensor may also be stored and used for a time-delayed action of the opening/retracting drive and/or the locking drive. For example, while driving, an operator may press the handle for manual emergency opening in order in general to thereby communicate his wish to open the bonnet or tailgate. This opening request is not complied with while driving because the control unit has acted on the locking drive for the locking element immediately when the motor vehicle is started up by also evaluating the signals from the speed sensor. As a result, the locking element is in its handle locking position while the motor vehicle is in motion.

Only when the vehicle has come to a standstill is the control unit able to evaluate the stored signal from the sensor in terms of the opening/retracting drive now being acted upon to open the bonnet or tailgate, without the handle being actuated or having to be actuated again. The stored signal from the sensor may in fact be evaluated by the control unit so that when the vehicle is at a standstill, the opening/retracting drive first opens the locking mechanism and then the catch hook.

The locking drive for the locking element is designed to be self-locking according to a particularly advantageous embodiment of the invention. In this way, the control unit is able to de-energize the locking drive after reaching a position that locks or releases the handle. This avoids unnecessary energy consumption for acting on the locking drive after one of its two end positions has been reached. In fact, in this context, the locking drive generally includes a worm wheel, which in general ensures the self-locking design of the locking drive as a whole.

As a result, a motor vehicle door lock is provided which offers a functionally reliable mechanical emergency opening, in particular, without the risk of the bonnet or door being opened unintentionally. The check of the position of the locking element with the aid of the sensor namely provides information about a possible opening request of an operator for manual emergency opening as well as about whether the locking element is in a position in which the handle is released or in a position in which the handle is locked. The signal from the sensor may now advantageously be evaluated by the control unit as a function of the speed and, for example, implemented in such a way that the locking element is moved into its handle locking position at a certain vehicle speed or when a threshold is exceeded for a predefined vehicle speed. The control unit may then de-energize the associated locking drive for the locking element.

The locking element maintains its position in which the handle is locked, by self-locking until the locking drive acts on the locking element in the direction of its releasing position with respect to the handle. This is usually only the case when the motor vehicle has come to a standstill after a previous drive. A potentially stored signal from the sensor assigned to the locking element may now be interpreted as an opening request for the tailgate or bonnet, meaning that the opening/retracting drive opens the bonnet immediately after the vehicle has come to a standstill (for a longer period of time) with no additional action on the handle. In this case, it may also be necessary to evaluate whether the engine is running in order not to misinterpret a waiting position of the motor vehicle as its standstill. For this purpose, the signal of at least one door contact switch is also evaluated with the aid of the control unit. As soon as the motor vehicle is stationary, the engine is switched off and, for example, the door contact switch signals that the vehicle door has been opened; this may be interpreted to mean that the vehicle has actually come to a standstill and the bonnet or tailgate may be opened safely. The essential advantages may be seen herein.

BRIEF DESCRIPTION OF DRAWINGS

The invention is explained in greater detail below with reference to drawings, which show only one exemplary embodiment. In the drawings.

DETAILED DESCRIPTION

Figure 1:
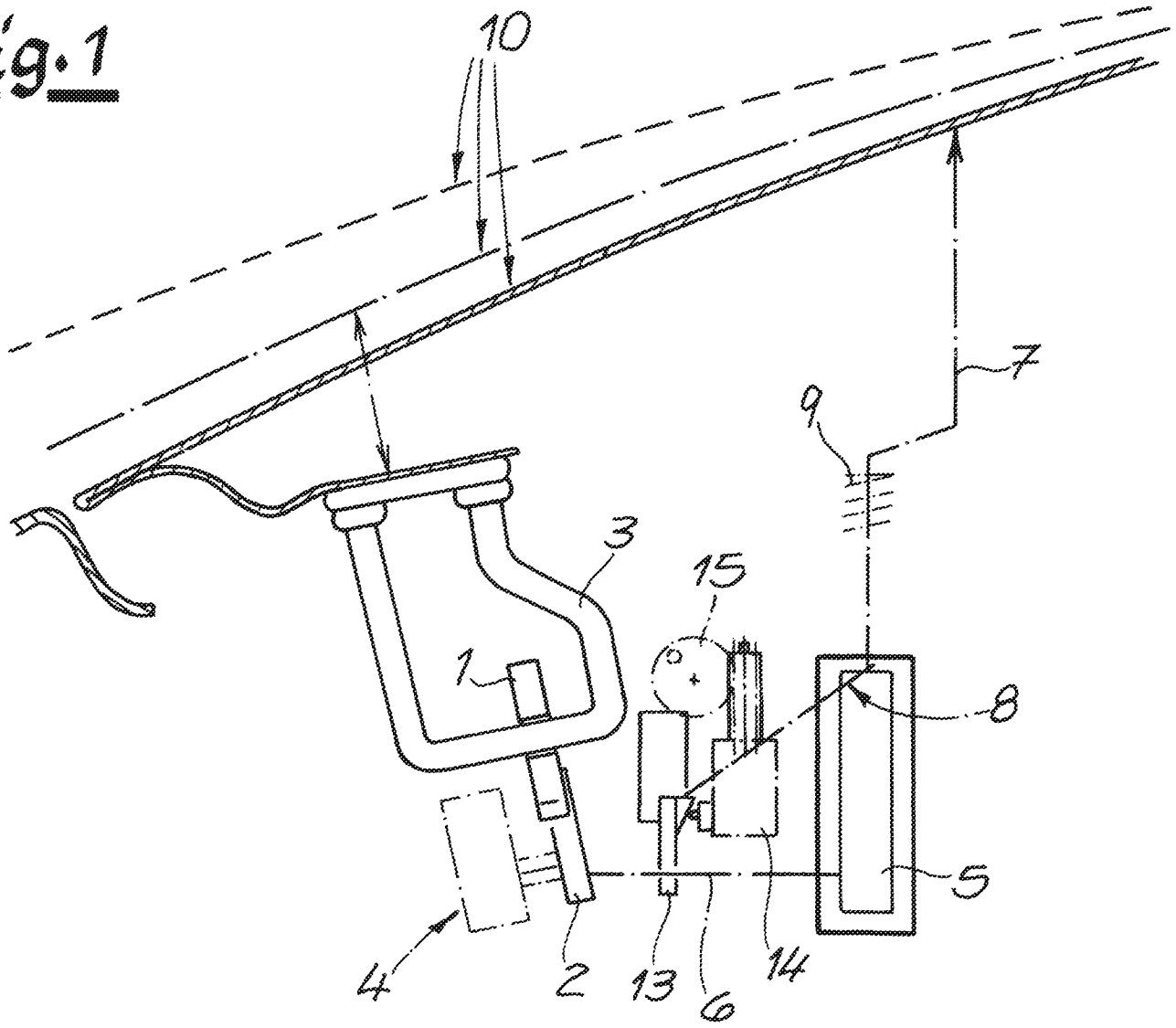
FIG. 1 schematically shows the motor vehicle door lock according to the invention in an overview.

A motor vehicle lock is shown in the figures. The motor vehicle door lock is composed of a body-side lock housing or motor vehicle door lock with a locking mechanism 1, 2 situated therein and a locking bolt bracket 3 on the bonnet or door side. Furthermore, an opening/retracting drive 4 for the locking mechanism 1, 2 is situated in the lock housing or motor vehicle door lock. In addition, a handle 5, which is mechanically coupled to the locking mechanism 1, 2 via a connecting element 6, is apparent schematically, particularly in FIG. 1. The opening/retracting drive 4, the handle 5 and the connecting element 6 taken together define an opening device 4, 5, 6. Finally, FIG. 1 also shows a sensing element 7, 8, 9 which senses movements of a bonnet or front bonnet 10 in the example. Different opening states of this front bonnet 10 are in fact shown in FIG. 1.

The solid-lined position of the front bonnet 10 corresponds to the closed state of the front bonnet 10, while the dash-dotted illustration forms a slight opening of the front bonnet 10 and, according to the exemplary embodiment, the catch position of the motor vehicle door lock, as will be explained in greater detail below. The dashed-lined position of the front hood 10 on the other hand represents its completely open state.

Figure 2:
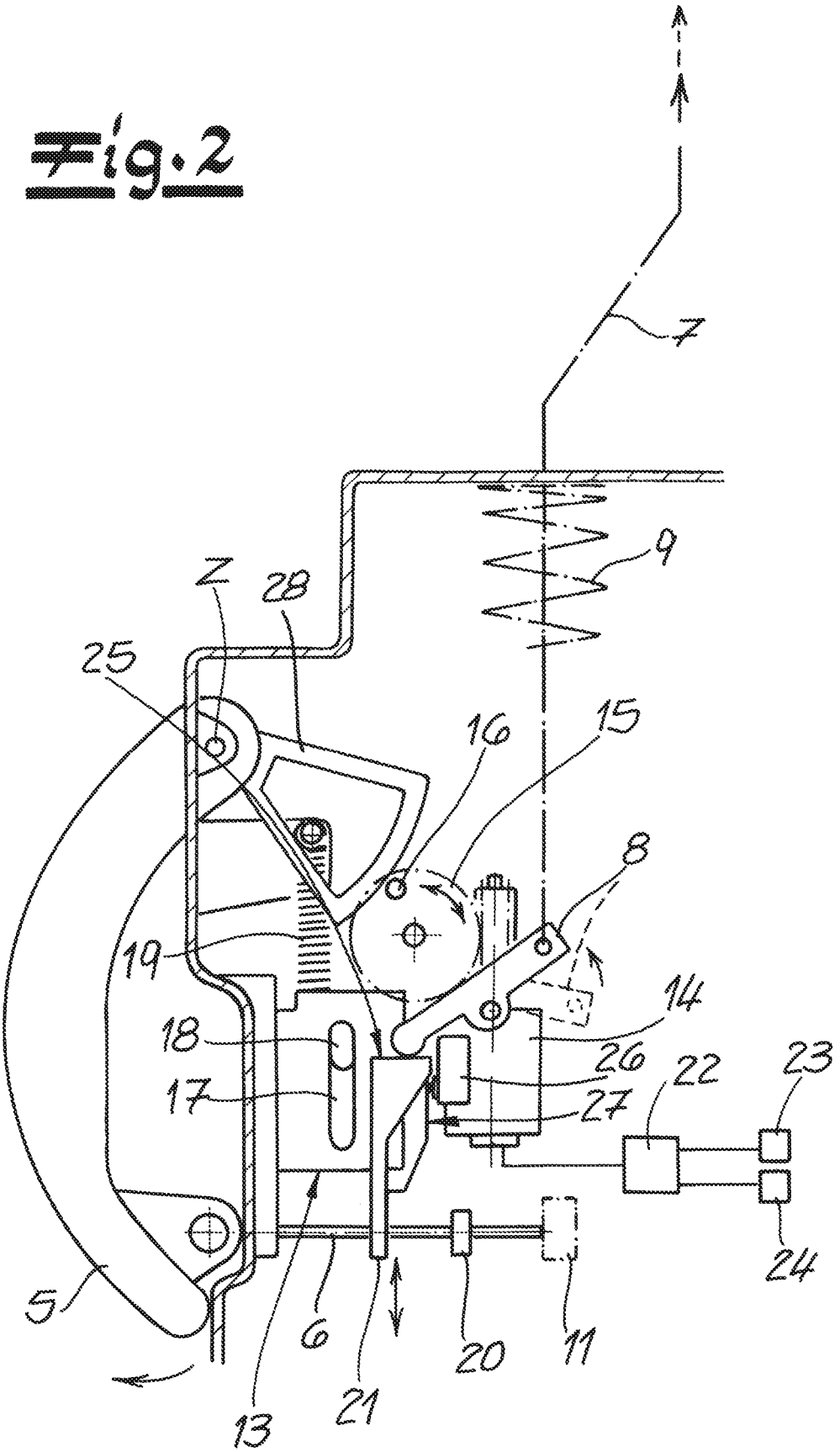
FIG. 2 shows the handle for emergency opening.
Figure 3:
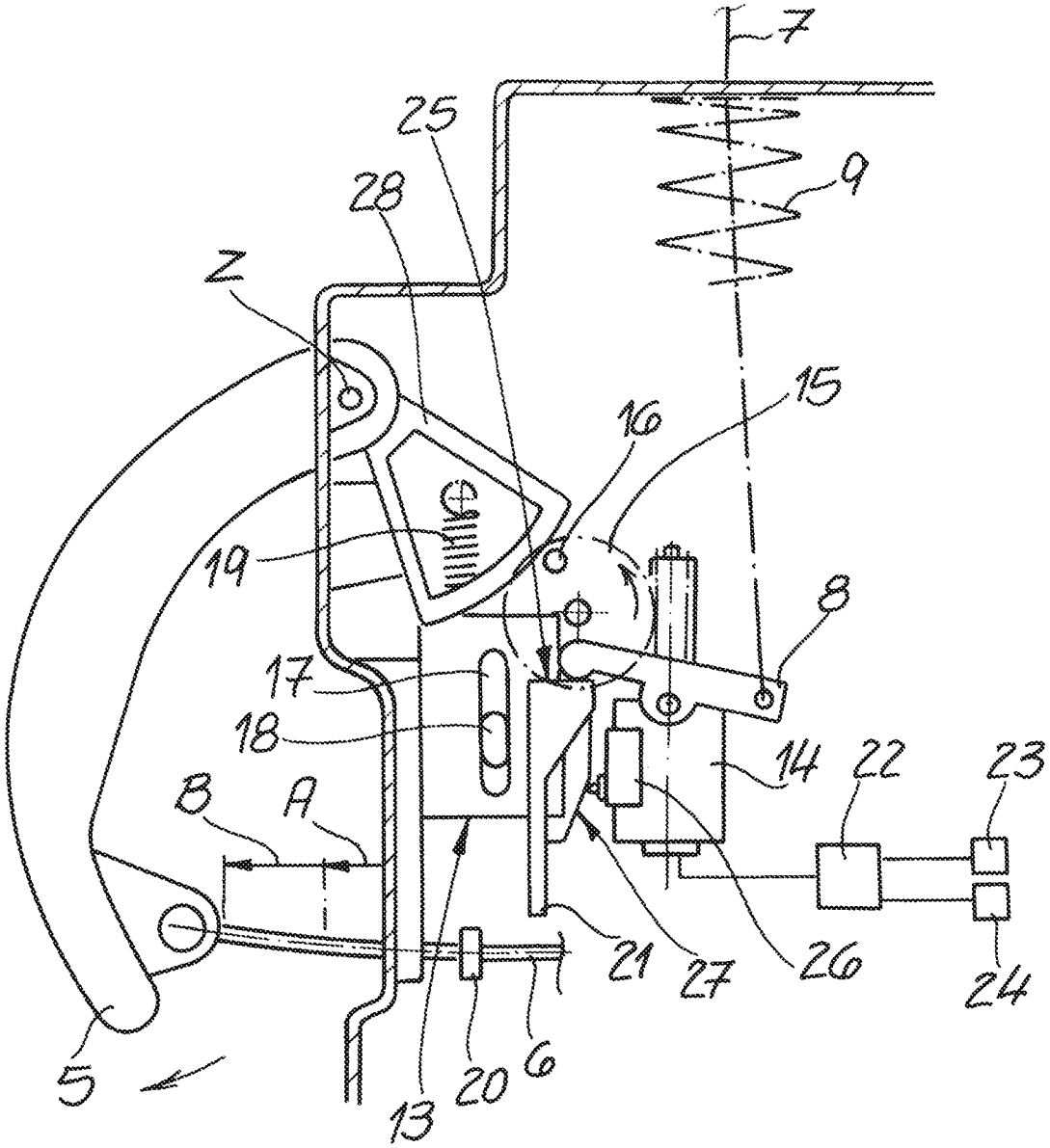
FIG. 3 shows the subject matter according to FIG. 2 with an emergency opening and completion of a first and second stroke by the handle and releasing position of the locking element.
Figure 4:
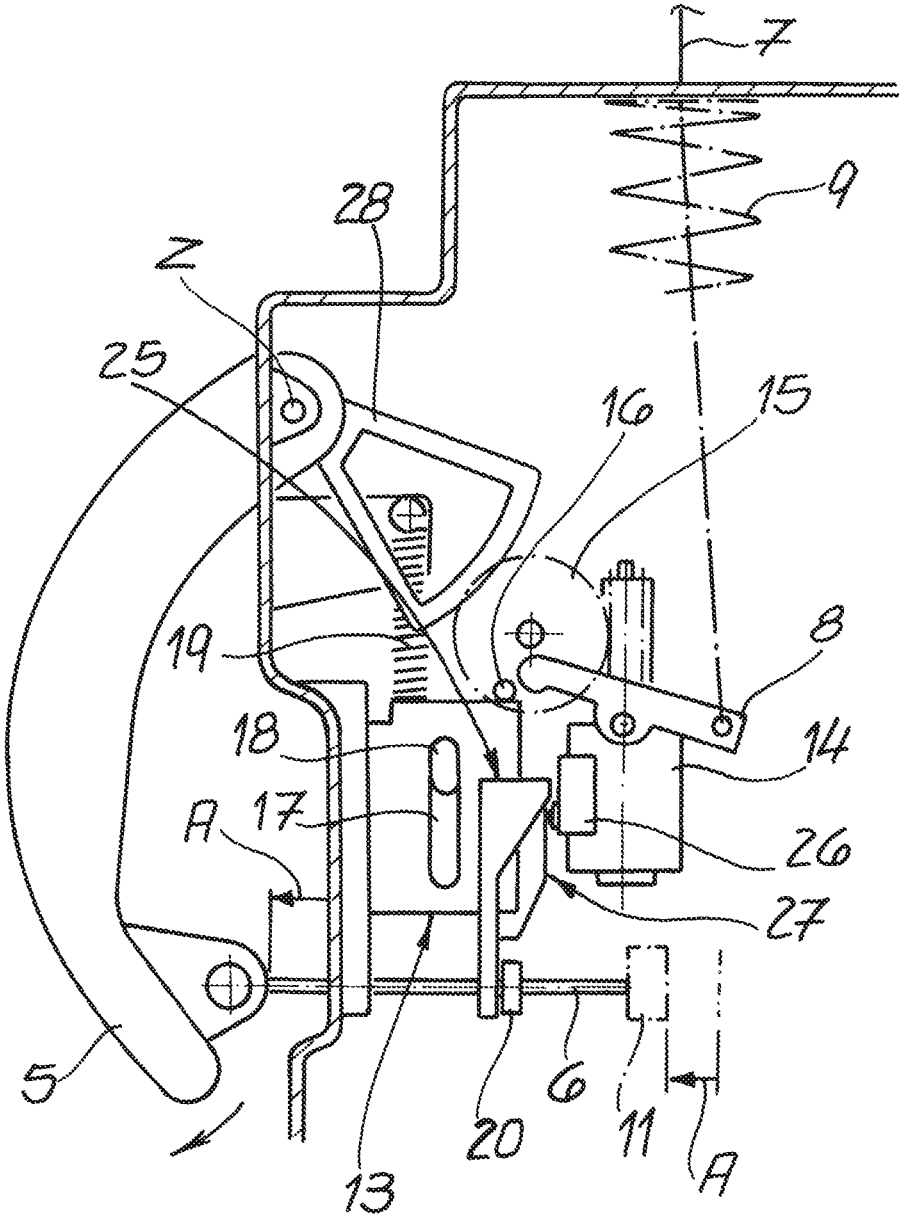
FIG. 4 shows the subject matter of FIG. 3 in the locking position of the locking element.
Figure 6:
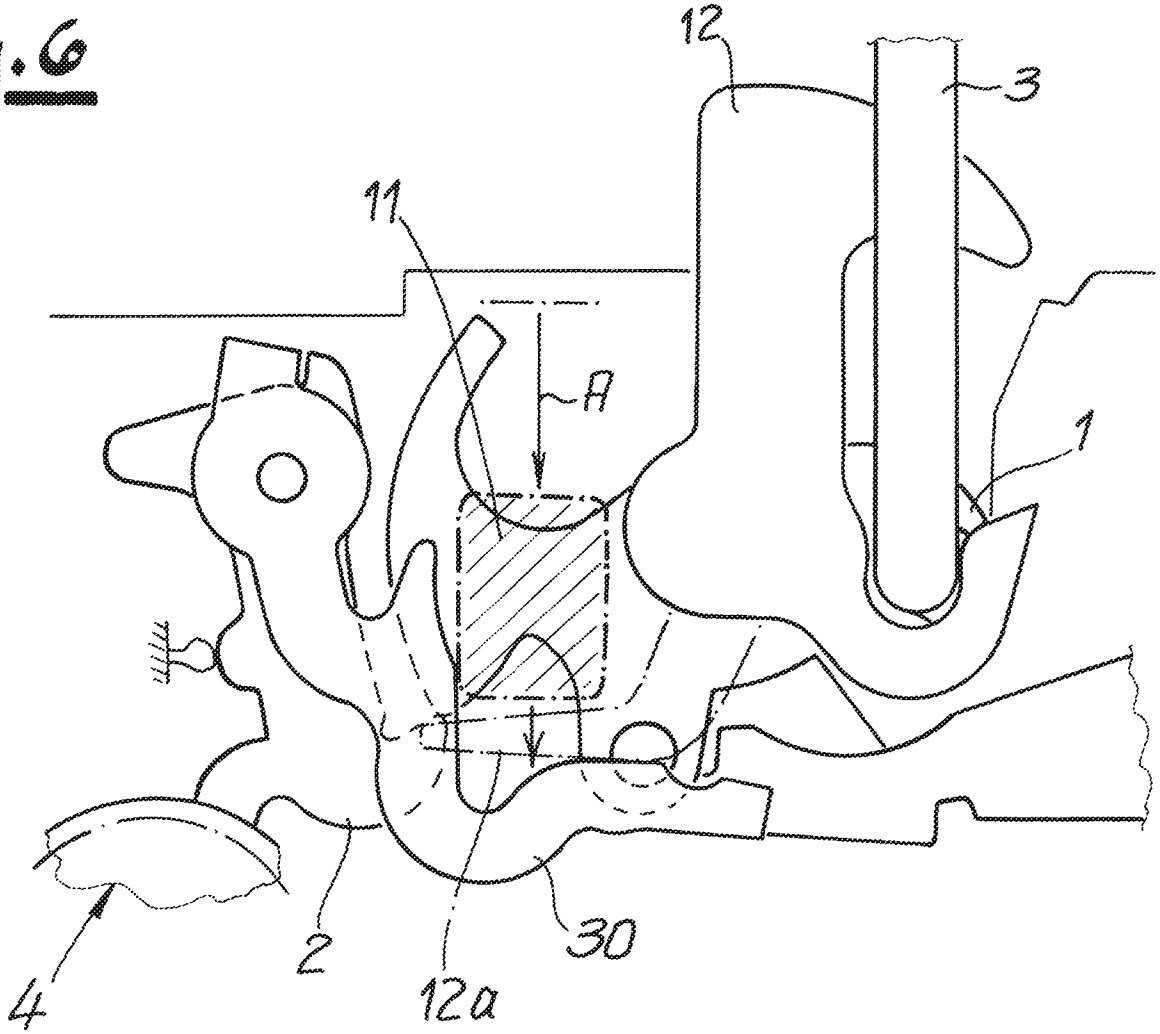
FIG. 6 shows an opening process of the pawl to the catch position.
Figure 7:
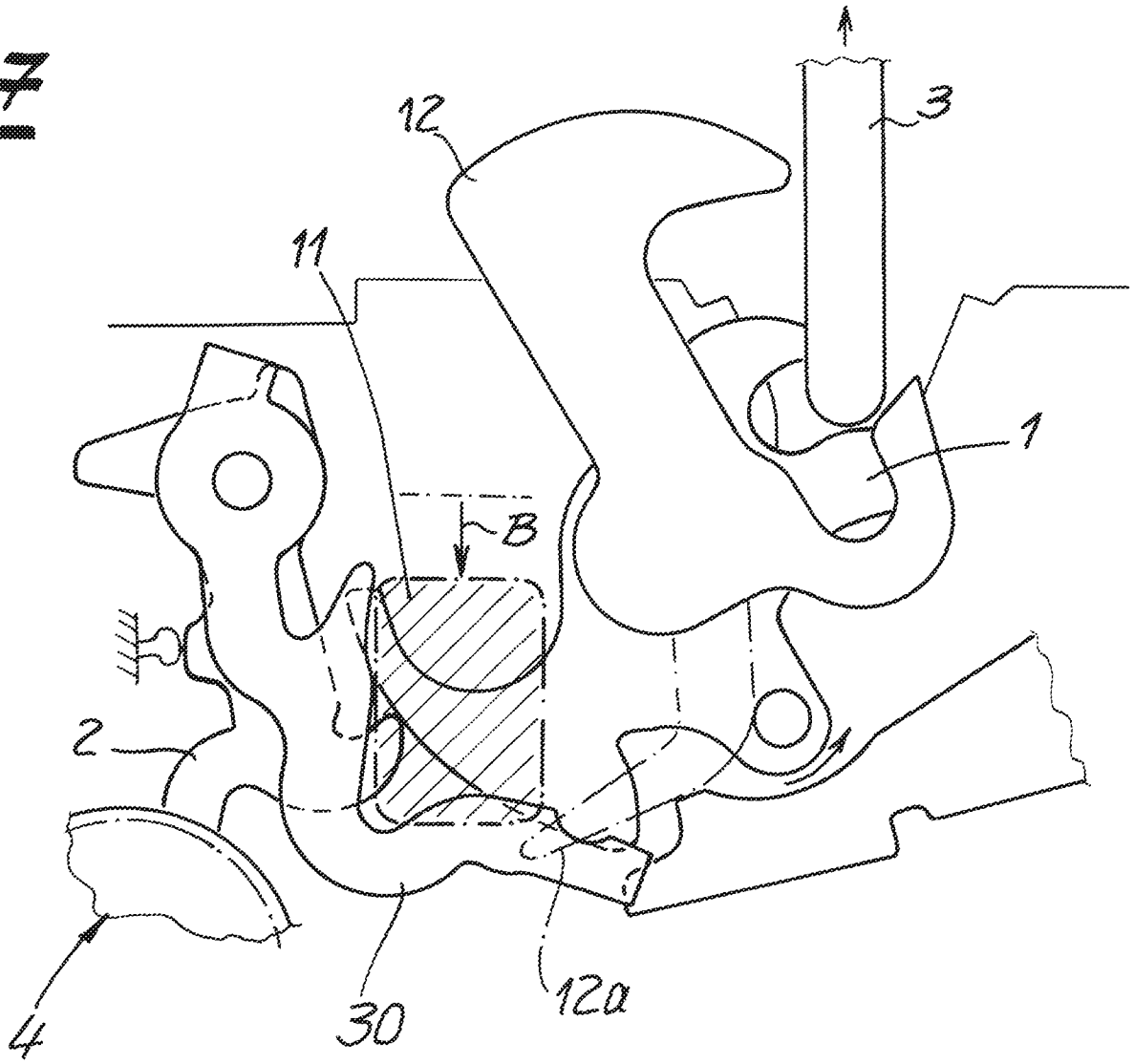
FIG. 7 shows a complete opening process of the bonnet or hatch including opening of the catch hook and FIGS. 8A through 8C schematically show a further embodiment of the handle schematically.

With the aid of the handle 5, at least the locking mechanism 1, 2 may be mechanically and manually opened in an emergency via the interposed connecting element 6, as is shown in particular in FIGS. 2 through 4. It is apparent that for this purpose the connecting element 6 effectuates the emergency opening via a slider 11 shown in detail in FIGS. 5 through 7, as will be shown in greater detail below. In the course of the emergency opening, the slider 11 operates on the pawl 2 and, if necessary, on a catch hook 12 as well. In this case, the slider 11 actually pivots an emergency opening lever 30 which, during its pivoting process, entrains the pawl 2 mounted on the same axis. As previously explained in the introduction, the locking bolt bracket 3 is secured both with the aid of the catch 1 and with recourse to the catch hook 12. Accordingly, an emergency opening with the aid of the handle 5 and the occupying of the position of the front bonnet 10 shown in full and in dashed lines in FIG. 1 corresponds with both the pawl 2 and thus the locking mechanism 1, 2 as well as the catch hook 12 being opened, as is shown in FIG. 7 and will be explained in greater detail below.

Figure 5:
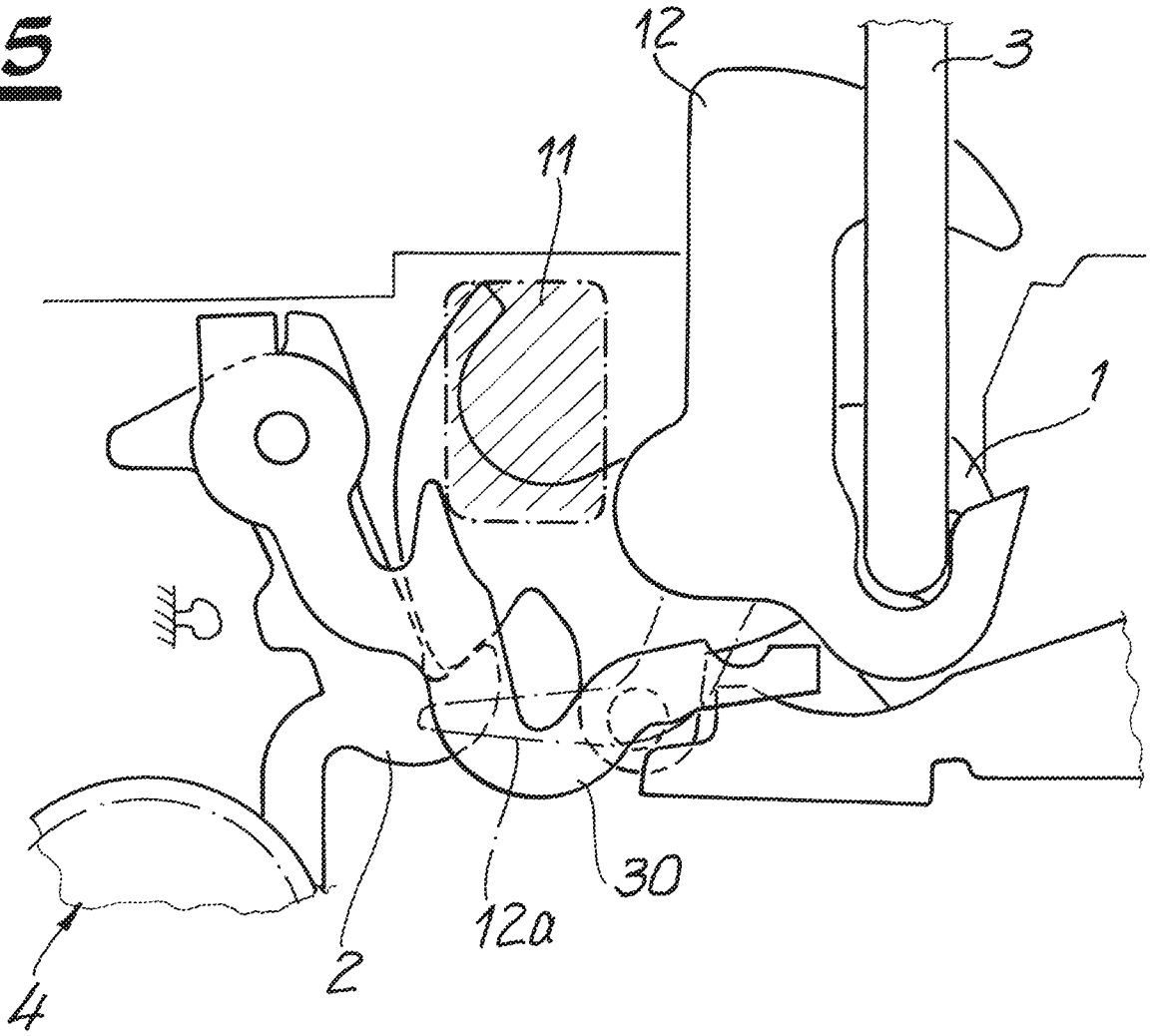
FIG. 5 shows the locking mechanism including catch hook in an overview.

The position of the front bonnet 10 shown with dash-dots in FIG. 1 on the other hand corresponds to the so-called catch position. This catch position occurs when, starting from the closed position of the motor vehicle door lock according to FIG. 5, the slider 11 acted upon with the aid of the handle 5 via the connecting element 6 only opens the pawl 2 and thus the locking mechanism 1, 2, whereas the catch hook 12 is not also opened. This corresponds to a first stroke A of the handle 5 and consequently of the connecting element 6, as shown in FIG. 5 and also in FIG. 4. If the front bonnet 10 as a whole is to be opened completely and is to assume its position as shown by the dashed line in FIG. 1, then, in addition to the first stroke A, the slider 11 and the handle 5, and with it the connecting element 6 must also complete the second stroke B. Only then is the catch hook 12 also opened, as is apparent in the transition from FIG. 6 to FIG. 7, and the locking bolt bracket 3 is released as a whole. This includes an emergency opening process using the handle 5. The slider 11 may namely then act accordingly on an extension 12*a* of the catch hook 12.

In principle, the front bonnet 10 or the locking mechanism 1, 2 may also be opened by an electric motor—usually when at a standstill. The opening/retracting drive 4 is provided for this purpose. For this purpose, the opening/retracting drive 4 may operate on the pawl 2 and, starting from its engagement with the catch 1, lift off from the closed position according to FIG. 5. As a result of this, the motor vehicle door lock transitions into the catch position because the opening/retracting drive 4 generally does not act on the catch hook 12; an opening of the catch hook 12 with the aid of the opening/retracting drive 4 is nevertheless possible.

In the context of the exemplary embodiment, the connecting element 6 is, and not limited to, a Bowden cable. The connecting element or the Bowden cable is connected to the handle 5. The handle 6 is a pivot lever hinged in the vehicle interior of the motor vehicle. It may be seen from FIG. 2 through 4 that the handle 5 or the pivot lever may, for example, be mounted pivotably about a vertical vehicle axis or Z-axis, as is indicated there. Other orientations and arrangements are of course also conceivable.

According to the invention, a locking element 13 engaging the connecting element 6 is now also provided. A locking drive 14, 15, 16 is assigned to the locking element 13. The locking element 13 may be moved with the aid of the associated locking drive 14, 15, 16 at least into a position that locks the handle 5 and into a position that releases it. The locking position of the locking element 13 is shown in FIG. 4. FIG. 3 on the other hand corresponds to the releasing position of the locking element 13. As a rule, and in particular when the motor vehicle is at rest, the locking element 13 assumes the releasing position as shown in FIG. 3. The locking drive 14, 15, 16 is acted upon in order to move the locking element 13 from the releasing position in FIG. 3 into the locking position according to FIG. 4. For this purpose, the locking drive 14, 15, 16 is composed of an electric motor 14 and a worm wheel 15. On its output shaft, the electric motor 14 has an output worm, which meshes with an external toothing of the worm wheel 15. In this way, the worm wheel 15 is able to basically execute clockwise and counterclockwise pivoting movements shown in FIG. 2, as indicated there by a double arrow.

In order to assume the locking position of the locking element 13 starting from the released position in FIG. 3, the electric motor 14 is now acted upon in such a way that the associated worm wheel 15 performs a counterclockwise movement during the transition from FIG. 3 to FIG. 4. This is indicated by a corresponding arrow. As a result, a pin or output pin 16 situated on the worm wheel 15 comes to rest on the locking element 13 on the top side and ensures that the locking element 13 is moved "downwards" starting from the releasing position in FIG. 3 during the transition to FIG. 4.

The locking element 13 in the exemplary embodiment is a locking slider 13, which is guided predominantly linearly with respect to the motor vehicle body. The locking element or locking slider 3 has an opening or elongated hole 17 for this purpose. A longitudinally extended and stationary or body-side guide pin 18 dips into the opening or elongated hole 17 in the locking element or locking slide 3. Accordingly, the mutual interaction between the guide pin 18 and the opening or elongated hole 17 results in the desired linear movement of the locking element or locking slider 13. This takes place overall against the force of a spring 19, which pretensions the locking element or the locking slider 3 according to the exemplary embodiment in the direction of its releasing position as shown in FIG. 3.

The locking element 13 interacts with a stop 20 on the connecting element 6 to limit the path of the connecting element 6 and consequently the handle 5. This interaction between the locking element 13 or a locking lug 21 at the end and the stop 20 takes place when the locking element 13 has assumed its locking position, as shown in FIG. 4.

In the context of the exemplary embodiment, the locking element or locking slider 13 is moved from its releasing position as shown in FIG. 3 into the locking position according to FIG. 4 with the aid of the locking drive 14, 15, 16 as a function of a vehicle speed of the motor vehicle. For this purpose, the locking drive 14, 15, 16 is connected to or is acted upon by a control unit 22. The control unit 22 also evaluates, among other things, signals of a speed sensor 23 and/or of one or more door contact switches 24. As soon as, in the exemplary embodiment, the speed sensor 23 determines, for example, that the vehicle speed has been exceeded, taking into account a particular threshold, for example walking speed, the control unit 22 evaluating the signal of the speed sensor 23 ensures that the locking drive 14, 15, 16 is activated in order to activate the locking element or to move the locking slide 13 from its releasing position in FIG. 3 into the locking position according to FIG. 4.

Only when the motor vehicle is stationary or is driving at walking speed and the speed sensor 23 transmits this to the control unit 22 does the control unit 22 act on the locking drive 14, 15, 16 to ensure that the locking element 13 is moved from its locking position shown in FIG. 4 back into the releasing position according to FIG. 3. In addition or alternatively, the one or the multiple door contact switches 24 may also be evaluated for this purpose. This means the locking element 13 assumes its releasing position according to FIG. 3 when the vehicle is at rest and/or when at least one further vehicle door is opened.

The handle 5 performs the previously mentioned stroke A until the locking position is reached, as shown in FIG. 4. Only when the locking element or the locking slide 13 assumes its releasing position according to FIG. 3 is the handle 5 able to also perform the second stroke B. As previously explained, only the pawl 2 of the locking mechanism 1, 2 and possibly a drive pawl, not shown in detail in the figures, as part of a retracting drive, also not shown in detail, is opened during the first stroke A. Only when the handle 5 and with it the connecting element 6 and the slider 11 are also able to complete the second stroke B is the catch hook 12 also opened via its extension 12*a*, as is apparent in the transition from FIG. 5 to FIGS. 6 and 7. The locking bolt bracket 3 is then completely free and the bonnet 10 may be pivoted from its previously assumed partially open and dash-dotted position into the completely open position shown in dashed lines.

The sensing element 7, 8, 9 previously indicated in FIG. 1 is shown overall in FIG. 2 through 4. The sensing element 7, 8, 9 is composed of a rod 7 that senses the front bonnet 10 on the underside and a pivot lever 8 that converts linear movements of the rod 7 into a rotation. The sensing element 7, 8, 9 also includes a spring 9 and ensures that the rod 7 is pre-tensioned in the direction of the front bonnet 10. When the bonnet or front bonnet 10 is at least partially open, the mechanical sensing element 7, 8, 9 ensures that a complete opening is not possible. This corresponds to the position indicated in FIG. 2. As soon as the front bonnet 10 assumes the partially open position associated with the first stroke A of the handle 5 and shown in dash-dotted lines, the rod or connecting rod 7 abutting the underside of the front bonnet 10 ensures that the pivot lever 8, starting from the closed position of the bonnet or front bonnet 10, is pivoted counterclockwise.

The closed position of the bonnet or front bonnet 10 in relation to the pivot lever 8 is shown in solid lines in FIG. 2. The pivoting movement of the pivoting lever 8 associated with the partially open position of the bonnet 10 is depicted with dashed lines in FIG. 2, as is the movement of the rod 7. As a result, an end of the pivot lever 8 opposite the coupling to the connecting rod 7 moves against a stop 25 on the locking element 13 and ensures that the locking element 13 maintains or assumes its position which locks the handle 5. This means, an opening of the front bonnet 10 is recognized and the handle 5 and with it the connecting element 6 are blocked. The mechanical scanning element 7, 8, 9 consequently ensures that overall the locking element or the locking slider 13 is mechanically moved into its position which locks the handle 5 as soon as the bonnet 10 reaches its catch position. As a result, the opening device 4, 5, 6 in the form of the opening/retracting drive 4 or the handle 5 is locked together with the connecting element 6 with the aid of the mechanical sensing element 7, 8, 9 in order to inhibit a complete opening of the bonnet 10.

The mechanical sensing element 7, 8, 9 interacting with the locking element 13 thus ensures, overall, a purely mechanical locking of the handle 5 or of the connecting element 6. This mechanical lock also functions if the locking drive 14, 15, 16 has failed, for example. It is key that the sensing element 7, 8, 9 locks the opening device 4, 5, 6, specifically the connecting element 6 and thus the handle 5, when the bonnet 10 or door or tailgate is at least partially open, in order to inhibit a complete opening of the bonnet 10. For this purpose, the spring 9 is provided, which pretensions the rod 7 in the direction of the bonnet 10. The rod 7 sensing the underside of the bonnet 10 is, or the linear movements thereof are, converted into rotations of the stationary pivot lever 8, which in the present case is designed as a two-arm lever with a central and stationary axis of rotation.

The (connecting) rod 7 is connected to one end or one arm of the pivot lever 8. The opposite end or the other arm of the pivot lever 8 moves in the open position of the bonnet 10 against the stop 25 of the locking element 13, as shown in FIG. 2. As a result, the locking element 13—independently of the locking drive 14, 15, 16—is moved purely mechanically via the sensing element 7, 8, 9 into its position which locks the connecting element 6.

The locking element 13 shown in detail in FIGS. 2 through 4 including the associated locking drive 14, 15, 16 is constructed according to the invention in such a way that the locking element 13 in comparison to the elongated connecting element 6 or a core of the Bowden cable apparent, in particular, in FIG. 2 is arranged vertically with the stop 20 arranged thereon and may be moved in this vertical direction with the aid of the locking drive 14, 15, 16 or the sensing element 7, 8, 9. This is indicated by a double arrow in FIG. 2. The opening or elongated hole 17 in the locking element 13 in conjunction with the stationary or body-mounted pin 18 ensures the corresponding linear guidance of the locking element 13. In addition, the movement of the locking element 13 takes place against the force of the spring 19, which is tensioned when the locking element 13 is moved from its locking position into the releasing position. As a result, the locking element 13 is pre-tensioned with the aid of the spring 19 in the direction of its releasing position.

A sensor 26 is also apparent in FIGS. 2 through 4. The sensor 26 is assigned to the handle 5. In addition, a movement of the locking element 13 may be sensed with the aid of the sensor 26. For this purpose, the sensor 26 is designed as a switch or microswitch, which interacts with a contour 27 on the locking element 13.

With the aid of the sensor 26, the position of the locking element or locking slider 13 is checked. At the same time, however, an action upon the handle 5 may also be sensed via the sensor 26. As soon as the handle 5 is pivoted clockwise about the axis Z, for example, in the illustration in FIG. 2, as indicated by a corresponding arrow in FIG. 2, the extension 28 on the handle 5 operates on the locking element 13 and acts on it at least partially. This means, when the handle 5 is acted upon, the blocking element 13 is acted upon at least to the extent that the contour 27 on the blocking element 13 interacts with the sensor 26 and generates a signal from the sensor 26 to be evaluated by the control unit 22. However, this is not mandatory. The extension 28 may just as well leave the blocking element 13 unaffected. In this case, a sensor (not shown) assigned to the handle 5 may transmit its actuation to the control unit 22.

The control unit 22 now acts on the opening/retracting drive 4 for the locking mechanism 1, 2 as a function of signals of the sensor 26 and/or of the sensor assigned to the handle 5. In fact, the signal from the sensor 26 and/or the sensor assigned to the handle 5 may be evaluated with the aid of the control unit 22 in terms of the opening/retracting drive 4 opening the locking mechanism 1, 2. This generally requires that the speed sensor 23 reports the standstill of the vehicle to the control unit 22 and, in addition, at least one door contact switch 24, for example, a vehicle door that is opened by a vehicle driver.

Alternatively or additionally, however, the locking drive 14, 15, 16 may also be acted upon as a function of signals from the sensor 26 with the aid of the control unit 22. According to the exemplary embodiment, a signal from the speed sensor 23 generally results in the locking drive 14, 15, 16 being acted upon with the aid of the control unit 22 in such a way that the locking element 13 leaves its previously assumed position releasing the handle 5 and is moved directly into its handle 5 locking position in order while driving to prevent an accidental opening of the bonnet or front bonnet 10 by acting on the handle 5.

In this case, for example, the signal from the sensor 26 may be stored. This may be repeated with the aid of the control unit 22. In this way, the signal from the sensor 26 may be used for a time-delayed action upon the opening/retracting drive 4. For example, if a vehicle driver acts on the handle 5 for manual emergency opening while driving, the locking element 13 in its locking position ensures that the handle 5 only performs the first stroke A and opens the pawl 2 and, if applicable, the drive pawl. The catch hook 12 continues to remain in its position securing the catch 1. As soon as the motor vehicle comes to a standstill and, for example, at least one door contact switch 24 is actuated, the control unit 22 interprets this as the vehicle at a standstill and may then, without actuating the handle 5 again, act on the opening/retracting drive 4 with a time delay in order to open both the pawl 2 or the locking mechanism 1, 2 and the catch hook 12.

The locking drive 14, 15, 16, previously described in detail above, is designed to be entirely self-locking. As a result, the control unit 22 is able in each case to de-energize the locking drive 14, 15, 16 after assuming a position that locks or releases the handle 5. In this way, unnecessary power consumption is avoided and a vehicle battery is not unnecessarily strained.

In addition and essentially, the design is such that the handle 5 for manual emergency opening of the locking mechanism 1, 2 operates with an extension 28 on the locking element 13 during its pivoting movement about the axis of rotation Z perpendicular to the plane of the drawing. This means the locking element 13 may on the one hand be moved in the linear direction with the aid of the locking drive 14, 15, 16. On the other hand, an action upon the locking element 13 in this linear direction via an action upon the handle 5 is possible by the handle 5 performing a clockwise movement about its axis of rotation Z indicated in FIG. 2.

This clockwise movement of the handle 5 corresponds with the extension 28 coupled to the handle 5 adjusting the locking element 13 in the linear direction, according to the exemplary embodiment, pushing it "downwards." The linear movement of the locking element 13 takes place only to the extent that the locking element 13 is unable to interact with the stop 20 on the connecting element 6, as is shown in FIG. 3. For this reason, in the releasing position shown in FIG. 3, the handle 5 is able to open not only the pawl 2 and, if necessary, the drive pawl, but also the catch hook 12. As a result of this, the locking bolt bracket 3 is released as a whole in the emergency opening implemented in this manner. This is because handle 5 or the slider 11 completes both the stroke A and then the stroke B. The slider 11 in this case comes into engagement with an emergency opening lever 30, which in turn acts on the pawl 2. The emergency opening lever 30 is in principle unnecessary.

In the event that, for example, the motor vehicle is driving and accordingly the speed sensor 23 reports a correspondingly increased vehicle speed or a vehicle speed above the threshold value to the control unit 22, the control unit 22 ensures that the locking drive 14, 15, 16 is acted upon. This is apparent in the transition from FIG. 3 to FIG. 4. Action upon the locking drive 14, 15, 16 now results in the locking element 13 moving into its position in front of the stop 20, which locks the handle 5, as depicted in FIG. 4. If, starting from this locking position of the locking element 13 in FIG. 4, the handle 5 is now acted upon in the sense previously described above, that is, in line with a clockwise movement about the axis Z for emergency opening, the slider 11 then performs only the stroke A. As a result of this, the pawl 2 and possibly the drive pawl are opened, but not the catch hook 12. The bonnet 10 assumes its partially open position according to the dash-dotted illustration in FIG. 1 (catch position).

A further action upon the handle 5 is unnecessary, since the sensor or microswitch 26 is acted upon unchanged during this process, and consequently the associated signal is able to be recorded and stored by the control unit 22, for example, after the vehicle has come to a standstill. This means the signal from the sensor 26 is stored and ensures that the locking drive 14, 15, 16 is acted upon with a time delay. In other words, while driving, the bonnet 10 remains in the partially open and dash-dotted position shown in FIG. 1. As soon as the vehicle comes to a standstill, the stored signal from the sensor 26 is converted by the control unit 22 in such a way that the locking drive 14, 15, 16 is moved from its position which locks the handle 5 into the releasing position. In addition, the stored signal from the sensor 26 may also ensure a time-delayed action on the opening drive 4, which opens the locking mechanism 1, 2 and also the catch hook 12 as a whole, so that the locking bolt bracket 3 is released and the bonnet 10 as a whole may be moved into its fully open position according to the dashed illustration. As a rule, the bonnet or front bonnet 10 is fully opened when the vehicle is at a standstill by, for example, the vehicle driver opening the catch hook 12 manually through the gap formed in the catch position between the front bonnet 10 and the body.

In FIGS. 8A-C and 9, a variant is shown in which the handle 5 is furnished in two parts including an interior lever 5*a* and a Bowden cable lever 5*b*. Both levers 5*a*, 5*b* are connected to one another in an articulated manner and are pre-tensioned by a spring or leg spring 29. As a result, pulling movements indicated in FIG. 8A on the interior lever 5*a* in the releasing position of the locking element 13 are transmitted to the Bowden cable lever 5*b* (see FIG. 8B). If, on the other hand, the locking element 13 is in its locking position, the Bowden cable lever 5*b* is blocked and the interior lever 5*a* is pivoted against the force of the leg spring 29 (see FIG. 8C).

Figure 8:
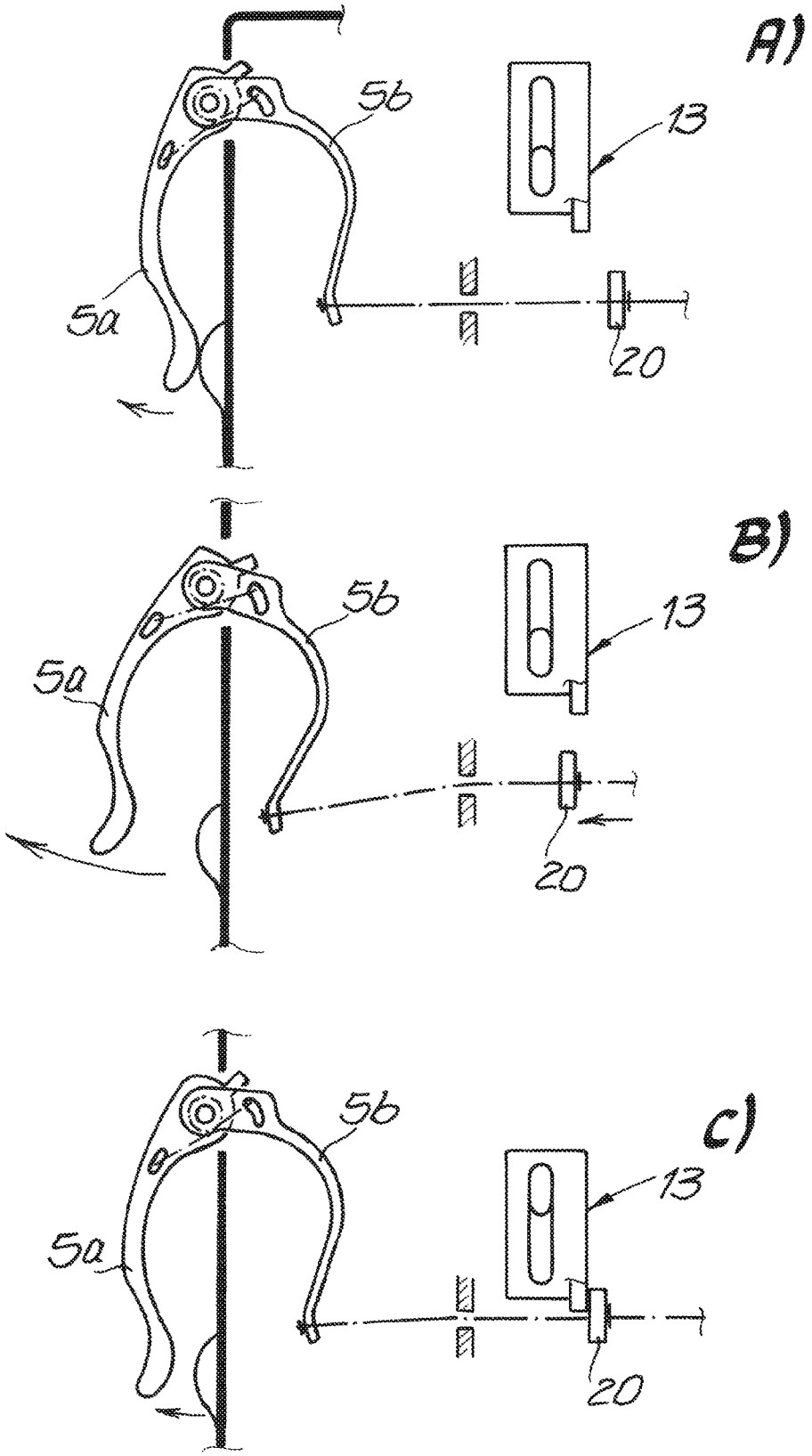
Figure 9:
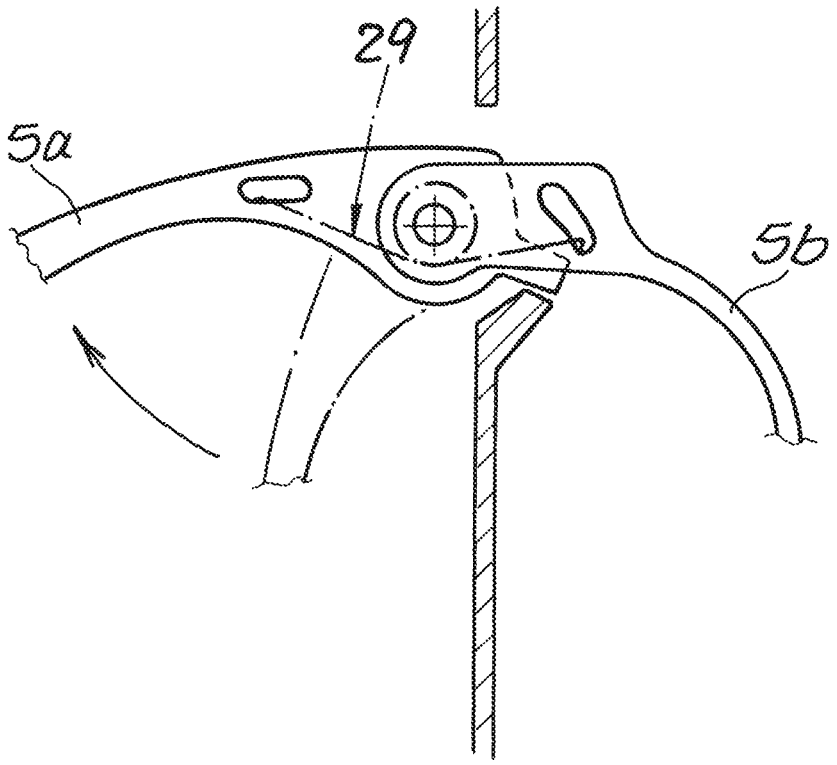
FIG. 9 shows an enlarged view of the subject matter according to FIGS. 8A through 8C.

The handle 5 is in fact furnished in two parts including the interior lever 5*a* and the Bowden cable lever 5*b*. The two aforementioned levers 5*a*, 5*b* are pivotably coupled to one another with the interposition of the spring 29. The spring 29 in this case is dimensioned in such a way that the Bowden cable lever 5*b* is carried along for acting upon the interior lever 5*a* with normal forces. The same applies to the Bowden cable or the connecting element 6, so that as a result the locking mechanism 1, 2 and possibly the drive pawl are opened as a whole. However, if the connecting element 6 is blocked with the aid of the locking element 13, as is indicated in FIGS. 8A through 8C, then an action upon the interior lever 5*a* results in the consequently blocked Bowden cable lever 6*b* not being moved. The movement of the interior lever 5*a* instead takes place against the force of the spring 29, which is accordingly pre-tensioned and deflected. In this way, the Bowden cable lever 5*b* and also the connecting element or the Bowden cable 6 may be constructed relatively easily, because excessive operating forces or a blockage of the connecting element 6 results in only the interior lever 5*a* being acted upon. This interior lever 5*a* therefore must only be designed to be relatively massive with an associated stop.

LIST OF REFERENCE NUMERALS

1 Catch
2 Pawl
3 Locking bolt bracket
4 Opening/retracting drive
5*a* Interior lever
5*b* Bowden cable lever
5 Handle
6 Connecting element, Bowden cable
7 Connecting rod
8 Pivot lever
9 Spring
7, 8, 9 Scanning element
10 Front bonnet
11 Slider
12 Catch hook
12*a* Extension
13 Locking element, locking slider
14 Electric motor
15 Worm wheel
16 Pin

14,15,16 Locking drive
17 Elongated hole
18 Guide pin
19 Spring
20 Stop
21 Locking nose
22 Control unit
23 Speed sensor
24 Door contact switch
25 Stop
26 Sensor
27 Contour
28 Extension
29 Leg spring
30 Emergency release lever
A First stroke
B Second stroke
Z Rotational axis

The invention claimed is:

1. A motor vehicle door lock comprising:

a body-side motor vehicle door lock having a locking mechanism and a bonnet-side or door-side locking bolt bracket;

at least one opening/retracting drive for the locking mechanism;

a handle for manual emergency opening of the locking mechanism via a connecting element mechanically coupled between the handle and the locking mechanism, wherein the connecting element includes a stop thereon;

a locking element configured to lock the handle; and at least one sensor configured to detect a position of the locking element, wherein the handle has a first stroke in which the connecting element moves a pawl of the locking mechanism to an open position while a catch hook of the locking mechanism retains the locking bolt bracket in the locking mechanism, wherein the stop is positioned on the connecting element such that action of the handle up to the first stroke is limited by the stop on the connecting element moving against the locking element, and wherein the handle has a second stroke in which the connecting element moves the catch hook to an open position to release the locking bolt bracket, when the locking element is moved into a handle-releasing position.

2. The motor vehicle door lock according to claim 1, wherein the handle has an extension which at least partially acts on the locking element.

3. The motor vehicle door lock according to claim 1, wherein the locking element is formed as a linearly guided locking slider having a locking nose that moves into a locking position in which the locking element locks the handle.

4. The motor vehicle door lock according to claim 3, wherein the linearly guided locking slider includes an elongated hole that receives a stationary guide pin.

5. The motor vehicle door lock according to claim 1, wherein the locking element has a contour which acts on the at least one sensor.

6. The motor vehicle door lock according to claim 5, wherein the at least one sensor is a microswitch.

7. The motor vehicle door lock according to claim 1 further comprising a control unit that acts on the opening/retracting drive for the locking mechanism and/or on a locking drive for the locking element as a function of signals from the at least one sensor.

8. The motor vehicle door lock according to claim 7, wherein the control unit is configured to evaluates signal from a speed sensor and/or from at least one door contact switch.

9. The motor vehicle door lock according to claim 7, wherein a signal from the at least one sensor is stored and used for acting on the opening/retracting drive and/or on the locking drive in a time-delayed manner.

10. The motor vehicle door lock according to claim 7, wherein the locking drive for the locking element is self-locking.

11. The motor vehicle door lock according to claim 7, wherein the control unit de-energizes the locking drive in each case after the locking drive has assumed a position in which the locking drive locks or releases the handle.

12. The motor vehicle door lock according to claim 1, wherein the locking element is configured to lock the handle in front of the stop.

13. The motor vehicle door lock according to claim 1 further comprising a locking drive for the locking element, wherein the locking drive is configured to move the locking element into a handle-releasing position in which the handle is configured to open the locking mechanism.

14. The motor vehicle door lock according to claim 13, wherein the handle has a first stroke and a second stroke that occurs after the locking element is moved into the handle-releasing position.

15. The motor vehicle door lock according to claim 1, wherein the locking mechanism includes a catch hook that is engageable by the bonnet-side or door-side locking bolt bracket.

16. The motor vehicle door lock according to claim 1, wherein the handle includes an interior lever and a Bowden cable lever that are pivotably coupled by a spring.

17. The motor vehicle door lock according to claim 1 further comprising a mechanical sensing element having a rod configured to detect a position of a front bonnet and a pivot lever that converts linear movement of the rod into a rotation.

* * * * *